US007484460B2

(12) United States Patent
Blum et al.

(10) Patent No.: US 7,484,460 B2
(45) Date of Patent: Feb. 3, 2009

(54) AMUSEMENT RIDE TRACK WITH MOTION BASE

(75) Inventors: Steven C. Blum, Orlando, FL (US); Michael R. Kiddoo, Orlando, FL (US); Scott R. Trowbridge, Windermere, FL (US)

(73) Assignee: Universal City Studios LLLP, Universal City, CA (US)

( * ) Notice: Subject to any disclaimer, the term of this patent is extended or adjusted under 35 U.S.C. 154(b) by 181 days.

(21) Appl. No.: 11/240,414

(22) Filed: Sep. 30, 2005

(65) Prior Publication Data

US 2007/0074638 A1 Apr. 5, 2007

(51) Int. Cl.
*A63G 1/00* (2006.01)

(52) U.S. Cl. ..... 104/53; 472/59

(58) Field of Classification Search ..... 440/53, 440/83, 85, 154; 472/59, 60, 130; 104/53, 104/83, 85, 154
See application file for complete search history.

(56) References Cited

U.S. PATENT DOCUMENTS

| | | | | |
|---|---|---|---|---|
| 5,009,412 | A * | 4/1991 | Roodenburg et al. | 472/59 |
| 5,513,990 | A * | 5/1996 | Gluck | 472/60 |
| 5,711,670 | A * | 1/1998 | Barr | 472/60 |
| 6,095,926 | A | 8/2000 | Hettema | |
| 6,113,500 | A | 9/2000 | Francis | |
| 6,902,488 | B2 * | 6/2005 | Hashimoto et al. | 472/59 |
| 6,941,872 | B2 * | 9/2005 | Roodenburg et al. | 104/53 |
| 2005/0098056 | A1 * | 5/2005 | Roodenburg et al. | 104/53 |

FOREIGN PATENT DOCUMENTS

| | | |
|---|---|---|
| DE | 20000558 U1 | 5/2000 |
| DE | 10049681 A1 | 4/2002 |

* cited by examiner

*Primary Examiner*—Lars A Olson
(74) *Attorney, Agent, or Firm*—Global Patent Operation

(57) ABSTRACT

An amusement ride has a track defining a ride vehicle path with a section of the track that can be decoupled from the main track and is subsequently movable on or about up to three axes with between one and six independent degrees of freedom.

18 Claims, 4 Drawing Sheets

AMUSEMENT RIDE TRACK WITH MOTION BASE

BACKGROUND OF THE INVENTION

The field of the invention relates to amusement or theme park attractions and rides. More specifically, the invention relates to a new and useful section of track for a fixed path amusement ride vehicle, which section of track can be decoupled from the fixed path for movement along or about up to three axes in space with between one to six degrees of freedom.

Various amusement rides have been created to provide passengers with unique motion and visual experiences, including roller coasters, themed rides, and simulators. Roller coasters and themed rides typically have the limitation of being a fixed ride experience, with changes to the ride being made only at great expense. As a result, passengers can become familiar with the ride, which limits the excitement of the ride. Additionally, roller coasters and theme rides generally lack the ability to be pointed and rotated in any direction.

To create improved rides, simulators have been placed on moving vehicles. The vehicle typically travels over a set course with the motion base providing e.g., controlled pitch, roll, yaw, heave, surge, and slip movement.

U.S. Pat. No. 6,095,926 describes one amusement ride vehicle having a vehicle chassis adapted for traveling on a fixed track and a motion base connected to the chassis. The motion base provides between one and six degrees of freedom to the ride vehicle relative to the chassis as it travels along on the fixed track.

Even these improved rides typically have a closed loop track path, with sidings for maintenance. Switches for directing a ride vehicle along a different section of the track are integrated to the fixed track and at least one rail is always connected to the track throughout the switch. Turntables, which do separate a track section at both ends have only one degree of freedom as they rotate. Further, turntables are limited by the rotation to changing the direction of a ride vehicle at a fixed angle of rotation from the original direction of travel and in the same plane. Other single degree of freedom track switch examples include transfer tracks, which move in one lateral degree of freedom, rotary switches that move about the roll axis, and teeter-totter switches that move about the pitch axis. Teeter-totter switches always have a vehicle on board the switch assembly in order to function, but it is not always the case with transfer tracks or rotary switches. Track sections of amusement rides are thus not generally separable or decoupled in three-space from other track sections for movement during a ride.

Accordingly, there is a need to provide an improved track section for an amusement ride vehicle.

BRIEF DESCRIPTION OF THE INVENTION

A track section for a dark ride, roller coaster or other ride system is mechanically decoupled from adjacent track members. The track section is sufficiently long to hold a corresponding ride vehicle. The track section is mounted to a motion base comprising at least two and up to six independent degrees of freedom, including translation along any of three coordinate axes, pitch, roll and yaw. The motion base may include a drive for imparting rotational motion in the yaw direction of 360 degrees or more. The ride vehicle is rigidly held in place on the track section during decoupling and any movement generated by the motion base.

In one embodiment of the track section, the track section is used as a multiple-position switching device. In such case, the switching device is not subject to the requirements that the switch is coplanar with other track, is axially symmetric or has a single radius of curvature motion, as are required for traditional track switches.

In an alternative embodiment of the invention, the track section movement is combined with a show or themed ride element to generate a ride experience for riders in the vehicle.

The various features of novelty which characterize the invention are pointed out with particularity in the claims annexed to and forming a part of this disclosure. For a better understanding of the invention, its operating advantages and benefits obtained by its uses, reference is made to the accompanying drawings and descriptive matter. The accompanying drawings are intended to show examples of the many forms of the invention. The drawings are not intended as showing the limits of all of the ways the invention can be made and used. Changes to and substitutions of the various components of the invention can of course be made. The invention resides as well in sub-combinations and sub-systems of the elements described, and in methods of using them.

DETAILED DESCRIPTION OF THE INVENTION

Figure 1:
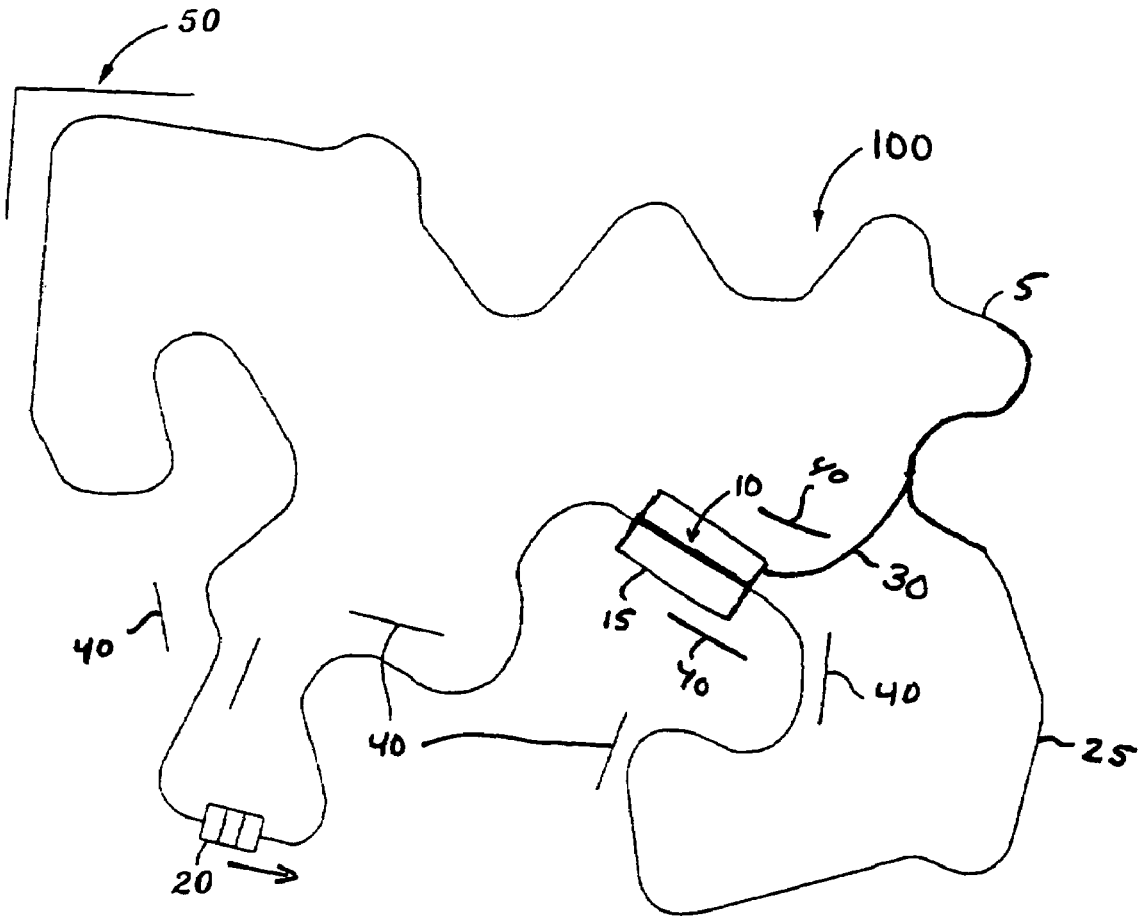
FIG. 1 is a schematic plan view of a fixed path track having a movable track section in accordance with one embodiment of the invention.

Referring now to the drawings in which like reference numerals are used to indicate the same or related elements, FIG. 1 illustrates generally a closed loop, fixed track path 100 of an amusement ride formed by track 5 for a ride vehicle 20. As used herein, the term track means a guide system, such as a rail for the vehicle 20, and may include a single rail, or two or more parallel rails along which the vehicle moves or is guided. The rail(s) forming the track can be one or more guide rails or one or more load rails, or combinations thereof. The guide system can also be an electronic guide system, such as one using electronic sensors and transmitters to define a path for a vehicle. Such systems include electronic devices for detecting the path defined by transmitters on the ground or adjacent a roadway on board the vehicle. Electronic guide systems usually do not require a mechanical guide as well, but one can be used in combination for safety. The vehicle 20 can be moved through the path 100 by a chain drive, gravity, on-board propulsion elements, or other device for moving the vehicle along the track 5. Separated or combined loading and unloading area(s) 50 is provided on part of the path 100 forming a beginning and end of the ride. Passengers board and disembark from the ride vehicle 20 at the loading and unloading area(s) 50, respectively.

The ride may have various scenery elements 40 located proximately along the track 5. The ride scenery elements 40 may be static or dynamic scenery, including projected images or three-dimensional figures and objects and special effects, such as flames, fog, smoke, scents, water or other fluid sprays.

Scenery elements 40 may be positioned at any point around the track 5, including above and below the plane of the track 5, depending on the desired scenery effect.

The path 100 includes a movable track section 10 which can be decoupled from the main track 5 for movement in any of at least two to six independent degrees of freedom. The movable track section 10 is mounted to a motion base or other articulating mechanism 15 for causing the movement in the up to six independent degrees of freedom. The motion base 15 may move the movable track section 10 in the x, y, z, pitch, roll and/or yaw directions. That is, the motion base 15 causes the movable track section 10 to move along or about any or all of the coordinate axes in three dimensions. When the ride vehicle 20 is on the movable track section 10, the ride vehicle 20 is stopped relative to the track section 10 and is preferably secured to the track section 10 for movement with the movable track section 10 by the motion base 15. The ride vehicle 20 is released for movement along the track 5 again once the movable track section 10 is recoupled to the main track 5 in at least the direction of the ride vehicle 20 travel.

As shown in FIG. 1, the track 100 may include a primary route 30 and an alternate route 25. The movable track section 10 functions as a switch between the primary route 30 and the alternate route 25, such as by translating the movable track section 10 sideways in combination with yaw movement to align with the track 5 of the selected route 25, 30. Advantageously, the motion base 15 provides sufficient displacement and rotation motion that conventional switch characteristics are not required. In particular, the motion base 15 movement in any of one to six independent degrees of freedom allows the switch to connect the movable track section 10 with other track 5 without regard to whether the tracks 5, 10 are coplanar, are axially symmetric or have a single radius of curvature motion, as required for traditional track switches.

Figure 2:
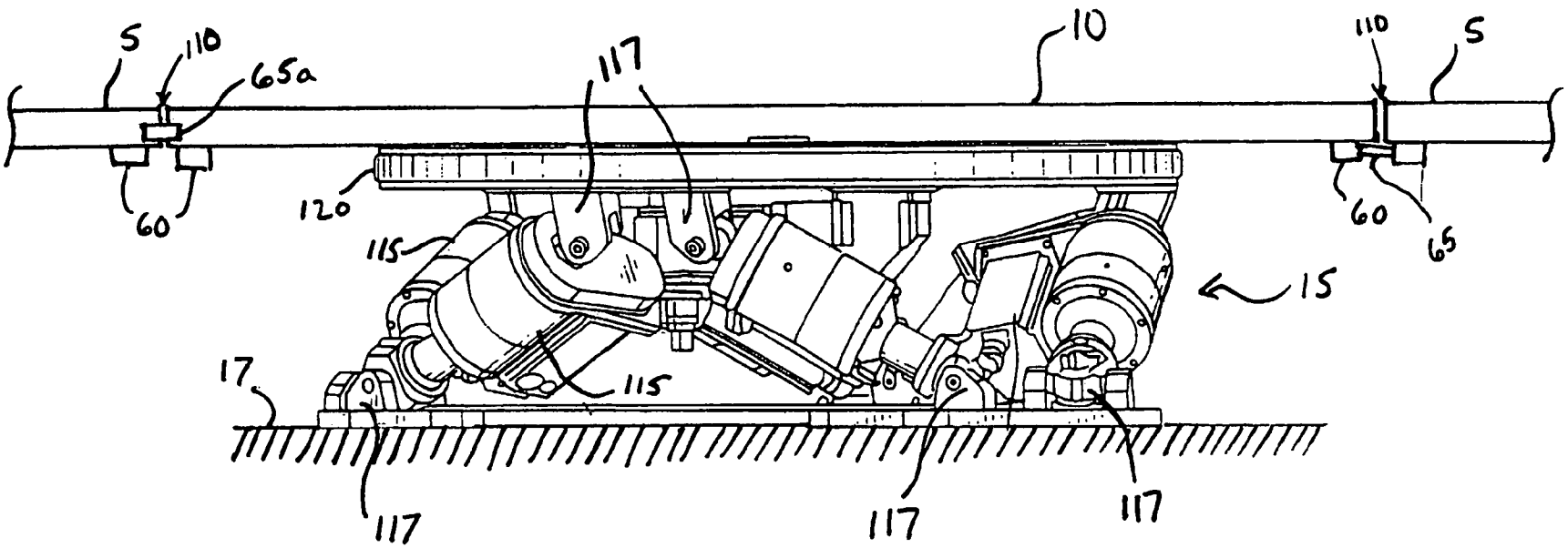
FIG. 2 is a side elevation view of a fixed path track including a movable track section according to an embodiment of the invention.

Referring now to FIG. 2, a movable track section 10 is shown between two fixed tracks 5. A small gap 110, preferably sized to be inconsequential to the ride vehicle 20 tires or wheels, is provided between the tracks 10, 5 to permit movement of the movable track section 10 without interference or obstruction by the fixed track 5. Sensors 60 are provided for aligning movable track section 10 and fixed tracks 5 to ensure track continuity when the ride vehicle 20 (not shown in FIG. 2) is moving. The sensors 60 may be any of several known types, including electromagnetic and electrooptical. Sensors 60 may include track locks 65 for mechanically joining and decoupling the movable track section 10 to the fixed track 5. The track locks 65 may be integrated with the sensors, or the track locks 65*a* can be separate devices. The track locks 65, 65*a* may be activated by the sensors 60, or by an alternative trigger mechanism, such as a manually-operated switch. Said sensors 60 can be integrated into the motion base 15 or other articulating mechanism and/or into the termination(s) of each track segment and/or locking or securement mechanisms. Preferably, sensors 60 are employed mounted to the actuating devices 115 on the motion base 15 or other articulating mechanism to provide feedback motion control of the motion base 15, and additional sensors 60 are mounted to the open fixed and movable track 5, 10 ends to provide redundant validation of the movable track 10 ends docking with the fixed track 5 ends. Finally, sensors 60 are also employed in connection with track locks 65, 65*a* to ensure the movable track 10 is secured subsequent to completion of a motion profile executed by the motion base 15 or other articulating mechanism.

The movable track section 10 is secured on top of a motion base 15. Motion base 15 includes a track support 120 for joining the track section 10 to actuators 115 for imparting movement in the up to six independent degrees of freedom. Actuators 115 are connected via single or multiple axis bearing assemblies 117 or equivalent structures such as universal joints, spherical bearings, ball joints, among others, between the track support 120 and a support platform 17 or the ground. The motion base 15 may include a bell-crank mechanism, planetary gear drive, belt and pulley drive or other equivalent drive mechanism (not shown) for rotating the track section 10 on track support 120 in the yaw direction. Such rotation can be greater than 360 degrees in either yaw direction. Similar mechanisms can be used to provide increased or continuous capability to rotate about the pitch or roll axes, if desired.

In an embodiment of the invention used as a track switch, the ride vehicle 20 may be slowed sufficiently and the movable track section 10 is sufficiently long, that the ride vehicle 20 may continue to travel on the track 10 as it is moved by motion base 15 between track switch positions. In such case, the sensors 60 and/or locks 65, 65*a* are used at one end of the movable track section 10 to determine when the switching is complete and secure the track sections in a continuous path for the ride vehicle 20. Preferably, appropriate blocking elements, such as brakes or other securing mechanisms (not shown in FIG. 2), are employed so that the ride vehicle 20 cannot traverse the movable track section 10 terminus at either end absent proper positioning and interlocking. After the ride vehicle 20 passes off the movable track section 10, it can be reset for the next ride vehicle 20 to approach.

Figure 3:
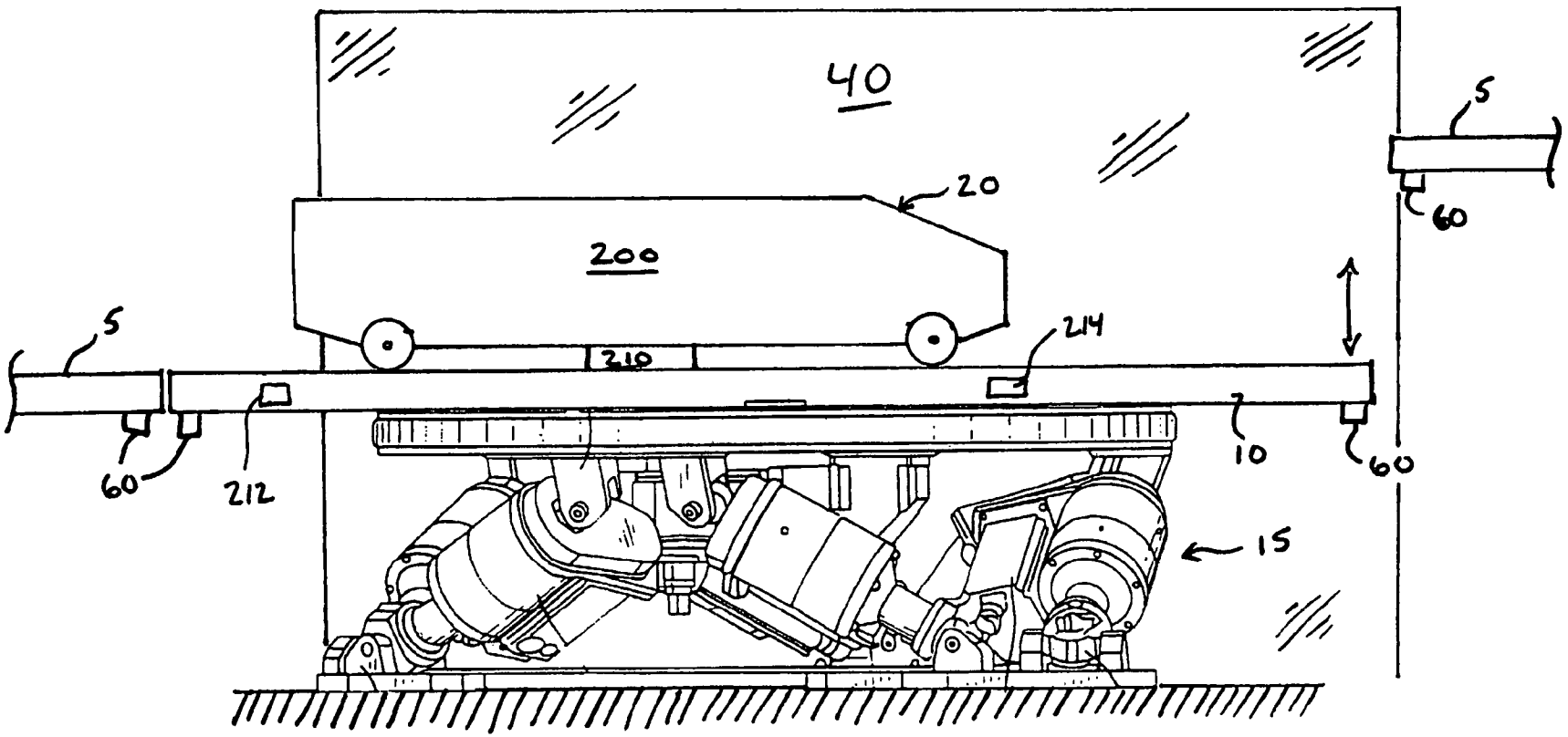
FIG. 3 is a side elevation view of the movable track section of FIG. 2 with a ride vehicle on the track section.

FIG. 3 illustrates a further embodiment of the invention in which the movable track section 10 is positioned between two different height sections of fixed track 5. The movable track section 10 is used to lift the ride vehicle 20 between sections of fixed track 5, as indicated by the directional arrow. A scenery element 40 is provided adjacent the movable track section 10 to enhance the ride experience. The scenery element 40 may provide some sensory effect to the riders in the ride vehicle 20 as it experiences motion complementary to the sensory effect of the scenery element 40, or simply motion associated with a track switching action.

Combined motions may be employed to alter the orientation of the ride vehicle 20 in three-space. For example, the ride vehicle may be yawed 50 degrees counter-clockwise, pitched 20 degrees down, rolled 20 degrees and translated laterally 1.3 meters according to a pre-programmed motion profile to match up with a fixed track section 5 in the ride vehicle 20 direction of travel. The combined motions can be done to enhance the show effect provided by proximately located scenery elements 40 in a themed ride, as well as to reposition the movable track section 10 between fixed track sections 5. For example, the motions above may be used to simulate a flying vehicle evading a pursuer when combined with active or passive scenery elements 40 displaying suitable background images. The extent of the motion provided by motion base 15 is limited only by the actuating mechanisms, so that displacements up to 20 m or more and rotational movement about any of the axes of 360 degrees or greater, and preferably between about 0-120 degrees and most preferably about 10-90 degrees can be achieved.

As shown in FIG. 3 a vehicle securing device 210 is provided for rigidly holding the vehicle body 200 on the track section 10. The vehicle securing device 210 can be mounted to either the ride vehicle 20 or to the movable track section 10, and is engageable with the other one of the vehicle 20 and track section 10. The vehicle securing device 210 can be, for example, a caliper brake connected to the ride vehicle 20 for locking on a portion of the track 10, a hook or clamp extending from the track 10 to releasably engage a bar or other portion of the ride vehicle 20, or other mechanism suitable for rigidly securing the ride vehicle 20 on the track section 10 when the track section 10 is decoupled from the fixed track 5. Sensors 212, 214 are preferably provided to ensure proper alignment of the ride vehicle 20 with the vehicle securing device 210. Sensors 212, 214 can also be used to determine whether the ride vehicle 20 is secured to the track and notify a controller of the vehicle securing device 210 status.

Figure 4:
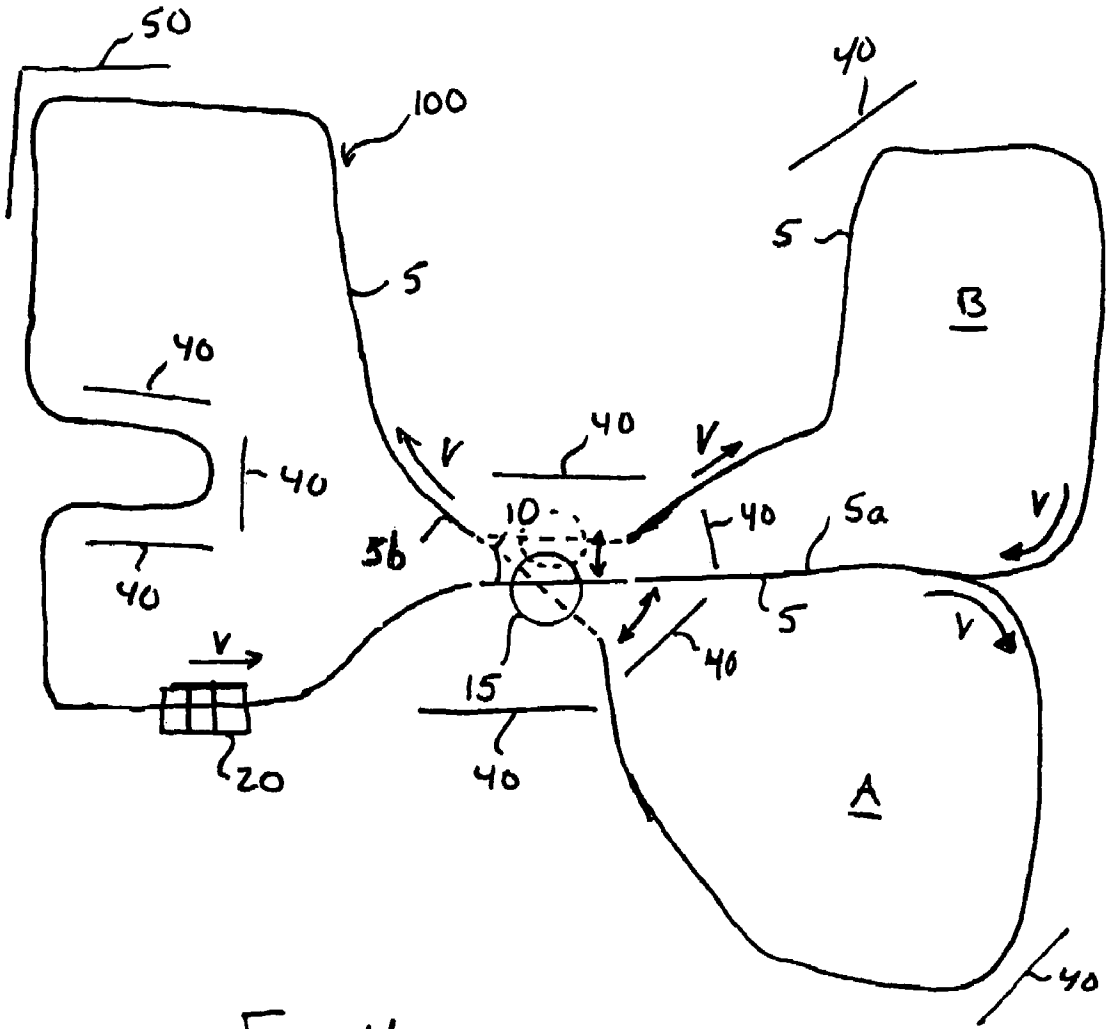
FIG. 4 is a schematic plan view of another fixed path track having a movable track section in accordance with a further embodiment of the invention.

FIG. 4 illustrates a further embodiment of an amusement ride having a fixed path 100 similar to the one shown in FIG. 1. The fixed path includes fixed track 5 and movable track section 10 on motion base 15. Scenery elements 40 are provided at selected points along the path 100. In this configuration, the movable track section 10 permits the amusement ride to re-use portions of the path 100 so that the ride occupies a smaller footprint. The movable track section 10 functions as a complex switch for directing the ride vehicle 20 between loops A and B. For example, as indicated by the arrows V, the ride vehicle may first travel across the movable track section 10, with or without stopping for motion effects in combination with scenery elements 40. The ride vehicle 20 then arrives back at the movable track section 10, where it is turned about 300 degrees for forward travel in the direction of arrow V through loop B, and subjected to lateral translation to line up with the fixed track 5 of loop B. If the scenery elements 40 are dynamic scenery or configurable scenery, then when the ride vehicle 20 is going through the switching from loop A to loop B, different effects may be experienced by the riders in the ride vehicle 20 than on the first pass to loop A. After passing around loop B, and returning again on fixed track section 5*a*, the movable track section 10 is used to switch the ride vehicle 20 to the return path 5*b* back to the loading and unloading station 50. In a still further embodiment of the multiple motion switching, track section 5*a* may be separate from loop B at a different elevation, but horizontally aligned with track 5 of loop A, so that the motion base 15 and movable track section 10 also changes the height of the returning ride vehicle 20 to match the return path track 5*b*.

The movable track section 10 advantageously provides greater motion to a ride vehicle 20 on a fixed path track 100 to enhance a ride experience without the expense of fitting individual ride vehicles with motion bases 15. For example, when it is desired to have additional motion besides forward or backward motion on a fixed path track at one point on the track 5, the movable track section 10 easily provides that motion to each ride vehicle passing that point on the track. Further, the movable track section 10 functions as an easily configurable track switch with multiple switch positions, rather than just one or two, and without conventional switch limitations. The movable track section 10 can also be used as a turntable with greater functionality than merely rotating the ride vehicle 20; the ride vehicle 20 may be turned, and, as well, lifted or tilted to mate the end of the movable track 10 in the direction of travel with another portion of the fixed track 5. In each case, scenery effects 40 are combinable with the motion of the movable track section 10 to enhance the riders' experiences on the amusement ride. The movable track section 10 is easily retrofit to existing rides by replacing the track supports for a particular section with the motion base 15 to form movable track section 10.

The movable track section 10 enable substantially enhanced entertainment potential in addition to significantly increased utility as a track switch. For example, in one embodiment, a ride vehicle 20 may enter a show scene and transition onto the movable track section 10. In this embodiment, the movable track section 10 is themed for the ride, such as by being part of a bridge assembly. A themed ride show sequence involving collapse of the bridge the movable track section 10 is part of may ensue while the ride vehicle 20 is on the movable track section 10. Various scenery elements 40 are provided proximate the movable track section 10 to create the themed experience. The motion capabilities of the movable track section 10 are used to enhance the show experience by more realistically simulating the bridge collapse, such as by executing falling and twisting movement of the movable track section 10 and ride vehicle 20. The motion of the movable track section 10 and scenery elements 40 are combined to form a show element that is enhanced over conventional effects. At the same time, the controlled movement repositions the movable track section 10 adjacent another fixed track 5 position for the ride vehicle 20 to continue through the themed ride.

In a still further embodiment of the movable track section 10 used as a show element, a roller-coaster type ride vehicle 20 can approach what at first appears to be a broken track segment, but is in fact the movable track section 10. Upon entering the movable track section 10, the ride vehicle is secured and the movable track section 10 executes motion dynamics consistent with causing riders to believe that the ride vehicle 20 had instead left the track 5. For example, significant pitch down motion combined with roll motion could be used. Again, the simulative motion of the movable track section 10 is combined with, or superimposed upon, motion designed to reconnect the movable track section 10 with a fixed track section 5 for continuing the ride. As will be apparent, the movable track section 10 provides many different ways in which the motion capabilities can enhance the ride experience in a variety of situations.

While the present invention has been described with references to preferred embodiments, various changes or substitutions may be made on these embodiments by those ordinarily skilled in the art pertinent to the present invention without departing from the technical scope of the present invention. Therefore, the technical scope of the present invention encompasses not only those embodiments described above, but all that fall within the scope of the appended claims.

What is claimed is:

1. A motion track for an amusement ride having a guide system defining a ride path for a ride vehicle, the motion track comprising:

a movable track section decoupleable from adjacent connected fixed track sections of the ride path; and a motion base supporting the movable track section and the motion base being configured for moving the movable track section in a direction along any of three coordinate axes, or any combination thereof, while also being configured for carrying out pitch, roll and yaw motions with the movable track section when the movable track section is decoupled.

2. The motion track section according to claim 1, further comprising sensing means associated with the movable track section for determining when the movable track section is aligned with at least one adjacent track section of the ride path.

3. The motion track according to claim 1, further comprising securing means for fixing the ride vehicle relative to the movable track section and blocking said ride vehicle from exiting the movable track section.

4. The motion track according to claim 3, further comprising sensing means associated with the movable track section for determining when the movable track section is aligned with an adjacent fixed track section in the intended direction of travel of the ride vehicle, said sensing means cooperating with said securing means to block said ride vehicle from exiting the movable track section until the sensing means determines the movable track section is recoupled to the adjacent fixed track section.

5. The motion track according to claim 1, further comprising a scenery element positioned proximate the movable track section, wherein movement of the motion base is coordinated with the scenery element to produce a show effect for the ride vehicle when the ride vehicle is on the movable track section.

6. The motion track according to claim 1, wherein the fixed track section at one end of the movable track section is in a different horizontal or vertical plane from the fixed track section at the other end of the movable track section, the motion base moving the movable track section between the fixed track sections to complete the ride path.

7. The motion track according to claim 1, wherein the ride path has a primary route and at least one alternate route, the movable track section and motion base forming a track switch selectively coupleable at one end of the movable track section to one of a primary route fixed track section and at least one alternate route fixed track section.

8. A method for imparting motion to a ride vehicle at a point along a ride path in an amusement ride having a track defining the ride path, the method comprising the steps of:

decoupling a movable track section from surrounding fixed sections of the track;

operating a motion base connected to the movable track section to move the movable track section in a direction along any of three coordinate axes, or any combination thereof, while also being configured for carrying out pitch, roll and yaw motions with the movable track section.

9. The method according to claim 8, further comprising securing the ride vehicle on the movable track section prior to operating the motion base.

10. The method according to claim 8, further comprising sensing when the movable track section is decoupled from the surrounding fixed track sections; and blocking the ride vehicle from moving off of the movable track section until at least one end of the movable track section is recoupled to one of the surrounding fixed track sections in the intended direction of movement of the ride vehicle.

11. An amusement ride having a guide system defining a ride path for a ride vehicle, comprising a movable track section of the ride path decoupleable from surrounding fixed track sections of the ride path connected to motion means supporting the movable track section and the motion base being configured for moving the movable track section in a direction along any of three coordinate axes, or any combination thereof, while also being configured for carrying out pitch, roll and yaw motions with the movable track section when the movable track section is decoupled from the surrounding fixed track sections.

12. The amusement ride according to claim 11, wherein the surrounding fixed track sections define a primary ride path and at least one secondary ride path, the movable track section switching between being coupled with the primary ride path and coupled with the at least one secondary ride path in response to a control signal.

13. The amusement ride according to claim 11, further comprising sensors connected with at least one of the motion means, said surrounding fixed track sections and said movable track section, said sensors for determining when the movable track section and surrounding track sections are in position for coupling.

14. The amusement ride according to claim 11, further comprising a scenery element positioned proximate the movable track section, the scenery element and motion of the movable track section combining to form a show element for a ride vehicle positioned on the movable track section.

15. The amusement ride according to claim 11, further comprising securing means for holding a ride vehicle on the movable track section while the motion base is moving the movable track section.

16. The amusement ride according to claim 15, wherein the securing means comprises at least one of a locking mechanism holding the ride vehicle to the movable track section, brakes, and a blocking mechanism preventing the ride vehicle from moving off of the movable track section.

17. The amusement ride according to claim 11, further comprising locking mechanisms on the movable track section for coupling with at least one of the surrounding fixed track sections and securing the track sections together.

18. A motion track for an amusement ride having a guide system defining a ride path for a ride vehicle, the track section comprising:

a movable track section decoupleable from adjacent connected fixed track sections of the ride path;

a motion base supporting the movable track section and having from two to six independent degrees of freedom for moving the movable track section in a direction along any three coordinate axes, pitch, roll and yaw directions when the movable track section is decoupled; and sensing means associated with the movable track section for determining when the movable track section is aligned with at least one adjacent track section of the ride path.

* * * * *